US010627146B2

(12) United States Patent
Wallis et al.

(10) Patent No.: US 10,627,146 B2
(45) Date of Patent: Apr. 21, 2020

(54) LIQUID SLUGGING DETECTION AND PROTECTION

(71) Applicant: Emerson Climate Technologies, Inc., Sidney, OH (US)

(72) Inventors: Frank S. Wallis, Sidney, OH (US); Randall Knick, Piqua, OH (US); Diane Belinda Patrizio, Piqua, OH (US); Richard Allen Miu, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 15/783,517

(22) Filed: Oct. 13, 2017

(65) Prior Publication Data

US 2018/0106520 A1 Apr. 19, 2018

Related U.S. Application Data

(60) Provisional application No. 62/409,001, filed on Oct. 17, 2016.

(51) Int. Cl.
*F04B 49/02* (2006.01)
*F25B 49/02* (2006.01)
(Continued)

(52) U.S. Cl.
CPC ..... *F25B 49/022* (2013.01); *F04B 49/02* (2013.01); *F04B 49/10* (2013.01); *F04B 49/20* (2013.01);
(Continued)

(58) Field of Classification Search
CPC .... F25B 49/02; F25B 49/022; F25B 2500/28; F25B 2500/18
See application file for complete search history.

(56) References Cited

U.S. PATENT DOCUMENTS 4,484,452 A 11/1984 Houser, Jr.
4,829,779 A 5/1989 Munson et al.
(Continued)

FOREIGN PATENT DOCUMENTS

CA 2753806 A1 3/2013
CN 101915481 A 12/2010
(Continued)

OTHER PUBLICATIONS

U.S. Appl. No. 15/819,406, filed Nov. 21, 2017, John Wallace.
(Continued)

*Primary Examiner* — Elizabeth J Martin
*Assistant Examiner* — Nael N Babaa
(74) *Attorney, Agent, or Firm* — Harness, Dickey & Pierce, P.L.C.

(57) ABSTRACT

A system includes a sensor and a controller for a refrigeration or HVAC system having a compressor. The sensor senses a temperature of the compressor during operation of the compressor. The controller is configured to determine a rate of change of the temperature relative to time and to perform one or more procedures to protect the compressor based on the rate of change of the temperature. The one or more procedures to protect the compressor include shutting down the compressor, throttling a pressure regulator valve of an evaporator associated with the compressor, adjusting an expansion valve associated with the evaporator, reducing speed of the compressor, and partially or wholly unloading the compressor.

26 Claims, 6 Drawing Sheets

(51) Int. Cl.

| | |
|---|---|
| ***F25B 49/00*** | (2006.01) |
| ***F25B 41/04*** | (2006.01) |
| ***F04B 49/10*** | (2006.01) |
| ***F04B 49/20*** | (2006.01) |
| *F25B 5/02* | (2006.01) |

(52) U.S. Cl.

CPC ..... *F25B 41/043* (2013.01); *F25B 49/005* (2013.01); *F25B 49/02* (2013.01); *F04B 2201/0402* (2013.01); *F04B 2201/0804* (2013.01); *F04B 2205/01* (2013.01); *F25B 5/02* (2013.01); *F25B 2400/075* (2013.01); *F25B 2500/08* (2013.01); *F25B 2500/26* (2013.01); *F25B 2500/28* (2013.01); *F25B 2600/0261* (2013.01); *F25B 2600/2513* (2013.01); *F25B 2600/2515* (2013.01); *F25B 2700/15* (2013.01); *F25B 2700/1931* (2013.01); *F25B 2700/1933* (2013.01); *F25B 2700/21151* (2013.01); *F25B 2700/21152* (2013.01); *F25B 2700/21161* (2013.01); *F25B 2700/21163* (2013.01); *F25B 2700/21171* (2013.01)

(56) References Cited

U.S. PATENT DOCUMENTS

| | | | | |
|---|---|---|---|---|
| 6,155,062 | A | 12/2000 | Santarnecchi | |
| 6,318,101 | B1 | 11/2001 | Pham et al. | |
| 6,321,543 | B1 | 11/2001 | Said et al. | |
| 6,578,373 | B1 | 6/2003 | Barbier | |
| 6,711,911 | B1 | 3/2004 | Grabon et al. | |
| 7,752,854 | B2 | 7/2010 | Singh et al. | |
| 7,845,179 | B2 | 12/2010 | Singh et al. | |
| 8,065,886 | B2 | 11/2011 | Singh et al. | |
| 8,734,125 | B2 | 5/2014 | McSweeney et al. | |
| 9,057,549 | B2 | 6/2015 | McSweeney | |
| 9,194,393 | B2 | 11/2015 | Pham | |
| 2003/0037555 | A1 | 2/2003 | Street et al. | |
| 2004/0016241 | A1 | 1/2004 | Street et al. | |
| 2004/0159113 | A1 | 8/2004 | Singh et al. | |
| 2005/0235664 | A1 | 10/2005 | Pham | |
| 2006/0048531 | A1* | 3/2006 | Eisenhour | B60H 1/3208 62/228.3 |
| 2006/0117766 | A1 | 6/2006 | Singh et al. | |
| 2006/0130501 | A1 | 6/2006 | Singh et al. | |
| 2007/0017240 | A1 | 1/2007 | Shapiro | |
| 2007/0033939 | A1* | 2/2007 | Wang | F02B 29/04 60/612 |
| 2007/0089440 | A1 | 4/2007 | Singh et al. | |
| 2008/0284449 | A1* | 11/2008 | Phadke | G01R 31/40 324/548 |
| 2009/0077983 | A1 | 3/2009 | Singh et al. | |
| 2009/0225479 | A1 | 9/2009 | Jayanth et al. | |
| 2009/0260376 | A1* | 10/2009 | Kasahara | F25B 49/005 62/149 |
| 2010/0138190 | A1 | 6/2010 | McConnell et al. | |
| 2010/0175400 | A1 | 7/2010 | Kasahara | |
| 2010/0179703 | A1 | 7/2010 | Singh et al. | |
| 2010/0212343 | A1 | 8/2010 | Swofford et al. | |
| 2011/0167852 | A1 | 7/2011 | Kawaai | |
| 2011/0238232 | A1 | 9/2011 | Tomita et al. | |
| 2012/0060529 | A1 | 3/2012 | Singh et al. | |
| 2012/0227427 | A1 | 9/2012 | Liu et al. | |
| 2013/0055742 | A1 | 3/2013 | Ouchi et al. | |
| 2013/0272840 | A1 | 10/2013 | Fujioka et al. | |
| 2014/0033746 | A1 | 2/2014 | McSWeeney | |
| 2014/0182366 | A1* | 7/2014 | Czimmek | F02M 53/06 73/114.45 |
| 2014/0208785 | A1 | 7/2014 | Wallace et al. | |
| 2014/0262134 | A1 | 9/2014 | Arensmeier et al. | |
| 2014/0308138 | A1 | 10/2014 | Pham | |
| 2015/0007597 | A1* | 1/2015 | Senf, Jr. | F25B 1/04 62/115 |
| 2015/0032583 | A1 | 1/2015 | Mello et al. | |
| 2017/0089598 | A1 | 3/2017 | Wallace et al. | |
| 2017/0089625 | A1 | 3/2017 | Wallace et al. | |

FOREIGN PATENT DOCUMENTS

| | | | |
|---|---|---|---|
| CN | 103362791 | A | 10/2013 |
| EP | 2333445 | A1 | 6/2011 |
| JP | H1089744 | A | 4/1998 |
| JP | 2002147819 | A | 5/2002 |
| JP | 2005090787 | A | 4/2005 |
| JP | 2011259656 | A | 12/2011 |
| KR | 20100036345 | A | 4/2010 |
| WO | WO-2008010988 | A1 | 1/2008 |
| WO | WO-2014149174 | A1 | 9/2014 |

OTHER PUBLICATIONS

Notice of Allowance regarding U.S. Appl. No. 15/197,121 dated Nov. 15, 2018.
Office Action regarding Canadian Application No. 2,990,972, dated Oct. 26, 2018.
U.S. Appl. No. 15/197,121, filed Jun. 29, 2016, John Wallace et al.
U.S. Appl. No. 15/197,169, filed Jun. 29, 2016, John Wallace et al.
International Search Report regarding International Application No. PCT/US2017/056771 dated Jan. 19, 2018.
Written Opinion of the International Searching Authority regarding International Application No. PCT/US2017/056771 dated Jan. 19, 2018.
Non-Final Office Action regarding U.S. Appl. No. 15/819,742 dated Sep. 10, 2018.
Non-Final Office Action regarding U.S. Appl. No. 15/197,121 dated Jun. 1, 2018.
Office Action regarding Australian Application No. 2016288216 dated Nov. 2, 2018.
Non-Final Office Action regarding U.S. Appl. No. 15/197,169 dated Dec. 28, 2018.
European Search Report regarding Application No. EP16818811.8, dated Feb. 11, 2019.
Extended European Search Report dated Jan. 8, 2019 for European Application No. EP16818821.7.
Final Office Action regarding U.S. Appl. No. 15/819,742 dated Jan. 24, 2019.
Notice of Allowance regarding U.S. Appl. No. 15/819,742 dated Mar. 25, 2019.
Office Action regarding Australian Application No. 2016288216 dated Mar. 20, 2019.
Office Action regarding Canadian Application No. 2,990,975 dated Nov. 6, 2018.
Final Office Action regarding U.S. Appl. No. 15/197,169 dated Jun. 26, 2019.
Non-Final Office Action regarding U.S. Appl. No. 15/819,046 dated Aug. 19, 2019.
Shimoda et al., Refrigeration Unit, May 22, 2002, JP2002147819A, Whole Document (Year: 2002).
U.S. Appl. No. 15/197,169, filed Jun. 29, 2016, John Wallace.
U.S. Appl. No. 15/819,046, filed Nov. 21, 2017, John Wallace.
U.S. Appl. No. 16/368,163, filed Mar. 28, 2019, John Wallace.
Final Office Action regarding U.S. Appl. No. 15/819,046 dated Nov. 29, 2019.
First Office Action regarding Chinese Patent Application No. 201680038021.X, dated Aug. 22, 2019. Translation provided by Unitalen Attorneys at Law.
First Office Action regarding Chinese Patent Application No. 201680038422.5, dated Sep. 17, 2019. Translation provided by Unitalen Attorneys at Law.
Office Action regarding Canadian Application No. 2,990,975, dated Nov. 7, 2019.
International Search Report regarding International Application No. PCT/US2016/040468, dated Oct. 25, 2016.
International Search Report regarding International Application No. PCT/US2016/040488, dated Oct. 18, 2016.

(56) References Cited

OTHER PUBLICATIONS

Written Opinion of the International Searching Authority regarding International Application No. PCT/US2016/040468, dated Oct. 25, 2016.
Written Opinion of the International Searching Authority regarding International Application No. PCT/US2016/040488, dated Oct. 18, 2016.
U.S. Appl. No. 15/197,121, filed Jun. 29, 2016, John Wallace.
U.S. Appl. No. 15/819,742, filed Nov. 21, 2017, John Wallace.

* cited by examiner

LIQUID SLUGGING DETECTION AND PROTECTION

CROSS-REFERENCE TO RELATED APPLICATIONS

This application claims the benefit of U.S. Provisional Application No. 62/409,001, filed on Oct. 17, 2016. The entire disclosure of the application referenced above is incorporated herein by reference.

FIELD

The present disclosure relates generally to refrigeration and Heat, Air Ventilation, and Cooling (HVAC) systems and more particularly to liquid slugging detection and protection in compressors used in refrigeration and HVAC systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Compressors are used in a wide variety of industrial and residential applications to circulate refrigerant within refrigeration, Heat, Air Ventilation, and Cooling (HVAC), heat pump, or chiller systems (generally referred to as "refrigeration systems") to provide a desired heating or cooling effect. In any of these applications, the compressor should provide consistent and efficient operation to ensure that the particular refrigeration system functions properly.

The compressor may include a crankcase to house moving parts of the compressor, such as a crankshaft. In the case of a scroll compressor, the crankshaft drives an orbiting scroll member of a scroll set, which also includes a stationary scroll member. The crankcase may include a lubricant sump, such as an oil reservoir. The lubricant sump can collect lubricant that lubricates the moving parts of the compressor.

When the compressor is off, liquid refrigerant in the refrigeration system generally migrates to the coldest component in the system. For example, in an HVAC system, during an overnight period of a diurnal cycle when the HVAC system is off, the compressor may become the coldest component in the system and liquid refrigerant from throughout the system may migrate to, and collect in, the compressor. In such case, the compressor may gradually fill with liquid refrigerant and become flooded.

One issue with liquid refrigerant flooding the compressor is that the compressor lubricant is generally soluble with the liquid refrigerant. As such, when the compressor is flooded with liquid refrigerant, the lubricant normally present in the lubricant sump can dissolve in the liquid refrigerant, resulting in a liquid mixture of refrigerant and lubricant.

Further, in an HVAC system, upon startup in the morning of a diurnal cycle, the compressor may begin operation in a flooded state. In such case, the compressor may quickly pump out all of the liquid refrigerant, along with all of the dissolved lubricant, in the compressor. For example, the compressor may pump all of the liquid refrigerant and dissolved lubricant out of the compressor in less than ten seconds. At this point, the compressor may continue to operate without lubrication, or with very little lubrication, until the refrigerant and lubricant returns to the suction inlet of the compressor after being pumped through the refrigeration system. For example, it may take up to one minute, depending on the size of the refrigeration system and the flow control device used in the refrigeration system, for the lubricant to return to the compressor. Operation of the compressor without lubrication, however, can damage the internal moving parts of the compressor, result in compressor malfunction, and reduce the reliability and useful life of the compressor. For example, operation of the compressor without lubrication can result in premature wear to the compressor bearings.

Traditionally, crankcase heaters have been used to heat the crankcase of the compressor to prevent or reduce liquid migration to the compressor and a flooded compressor state. Crankcase heaters, however, increase energy costs as electrical energy is consumed to heat the compressor. Additionally, while crankcase heaters can be effective for slow rates of liquid migration, crankcase heaters can be less effective for fast rates of liquid migration, depending on the size or heating capacity of the crankcase heater.

SUMMARY

A system for liquid slugging detection and floodback protection is provided and includes a sensor to sense a temperature of a compressor of a refrigeration or HVAC system during operation of the compressor and a controller for the refrigeration or HVAC system. The controller is configured to determine a rate of change of the temperature relative to time and to shut down the compressor based on the rate of change of the temperature.

In other features, the sensor senses the temperature proximate to a discharge port of the compressor.

In other features, the sensor senses the temperature proximate to a suction port of the compressor.

In other features, the controller is further configured to restart the compressor using a bump-start procedure after shutting down the compressor based on the rate of change of the temperature.

In other features, the controller is further configured to, in response to the rate of change of the temperature being negative, integrate a function of a temperature gradient of the compressor and shut down the compressor by comparing a value of the integrated function to a predetermined threshold.

In other features, the controller is further configured to shut down the compressor based on the rate of change of the temperature without knowledge of operating conditions of the compressor including suction superheat and suction and discharge pressures of the compressor.

In other features, the controller is further configured to shut down the compressor based on the rate of change of the temperature by assuming a value of suction superheat before a flood-back event occurs.

In other features, the controller is further configured to communicate with a remote controller and to shut down and restart the compressor using a bump-start procedure based on data received from the remote controller irrespective of whether the rate of change of the temperature indicates occurrence of a flood-back event requiring a shut down and restart of the compressor using the bump-start procedure.

In other features, the compressor is a variable capacity compressor, and the controller is further configured to operate the compressor at a lower than normal capacity during at least a portion of the bump-start procedure.

In other features, the controller is further configured to adjust the predetermined threshold based on a difference between the sensed temperature and a minimum discharge line temperature representing zero suction superheat or an acceptable wet suction quality limit and to shut down the compressor by comparing the value of the integrated function to the predetermined threshold adjusted based on the minimum discharge line temperature.

In other features, the controller is further configured to adjust one or more terms of the function based on a location of the sensor relative to the compressor.

In other features, the controller is further configured to receive feedback from the compressor and adjust at least one of the predetermined threshold and one or more terms of the function based on the feedback.

In other features, the controller is further configured to receive from a remote controller the minimum discharge line temperature determined based on a plurality of operating parameters of the compressor including properties of refrigerant, efficiency of the compressor, and suction and discharge pressures of the compressor.

In other features, the feedback is from a knock sensor indicating a change in cylinder pressure in the compressor based on an amount of liquid entering a cylinder of the compressor.

In other features, the feedback includes a temperature measurement of lubricant sump.

In other features, the feedback includes a change in amperage of compressor motor or compressor power indicating liquid entering compression chamber of compressor.

A method for liquid slugging detection and floodback protection is provided and includes sensing, with a sensor, a temperature of a compressor of a refrigeration or HVAC system during operation of the compressor; determining, with a controller, a rate of change of the temperature relative to time; and shutting down the compressor with the controller based on the rate of change of the temperature.

In other features, the sensor senses the temperature proximate to a discharge port of the compressor.

In other features, the sensor senses the temperature proximate to a suction port of the compressor.

In other features, the method further comprises restarting the compressor, with the controller, using a bump-start procedure after shutting down the compressor based on the rate of change of the temperature.

In other features, the method further comprises, in response to the rate of change of the temperature being negative, integrating, with the controller, a function of a temperature gradient of the compressor and shutting down the compressor by comparing a value of the integrated function to a predetermined threshold.

In other features, the method further comprises shutting down the compressor, with the controller, based on the rate of change of the temperature without knowledge of operating conditions of the compressor including suction superheat and suction and discharge pressures of the compressor.

In other features, the method further comprises shutting down the compressor, with the controller, based on the rate of change of the temperature by assuming a value of suction superheat before a flood-back event occurs.

In other features, the method further comprises shutting down and restarting the compressor, with the controller, using a bump-start procedure based on data received from a remote controller irrespective of whether the rate of change of the temperature indicates occurrence of a flood-back event requiring a shut down and restart of the compressor using the bump-start procedure.

In other features, the compressor is a variable capacity compressor, and the method further comprises operating the compressor, with the controller, at a lower than normal capacity during at least a portion of the bump-start procedure.

In other features, the method further comprises adjusting, with the controller, the predetermined threshold based on a difference between the sensed temperature and a minimum discharge line temperature representing zero suction superheat or an acceptable wet suction quality limit. The method further comprises shutting down the compressor, with the controller, by comparing the value of the integrated function to the predetermined threshold adjusted based on the minimum discharge line temperature.

In other features, the method further comprises adjusting, with the controller, one or more terms of the function based on a location of the sensor relative to the compressor.

In other features, the method further comprises receiving, with the controller, feedback from the compressor and adjusting at least one of the predetermined threshold and one or more terms of the function based on the feedback.

In other features, the method further comprises receiving, with the controller, the minimum discharge line temperature determined by a remote controller based on a plurality of operating parameters of the compressor including properties of refrigerant, efficiency of the compressor, and suction and discharge pressures of the compressor.

In other features, the method further comprises receiving, with the controller, the feedback from a knock sensor indicating a change in cylinder pressure in the compressor based on amount of liquid entering a cylinder of the compressor.

In other features, the feedback includes a temperature measurement of lubricant sump.

In other features, the feedback includes a change in amperage of compressor motor or compressor power indicating liquid entering compression chamber of compressor.

This section provides a general summary of the disclosure, and is not a comprehensive disclosure of its full scope or all of its features.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The drawings described herein are for illustrative purposes only of selected embodiments and not all possible implementations, and are not intended to limit the scope of the present disclosure.

In the drawings, reference numbers may be reused to identify similar and/or identical elements.

DETAILED DESCRIPTION

Figure 1:
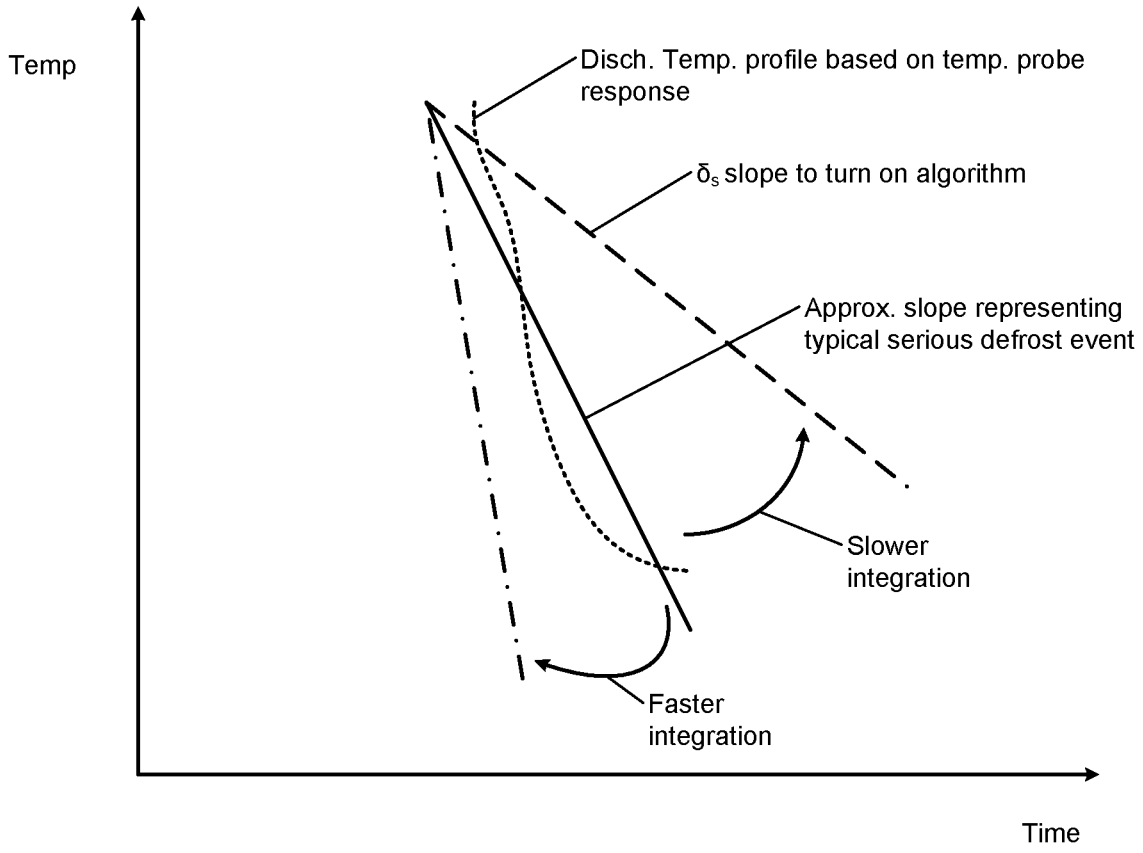
FIG. 1 is a graph of compressor temperature versus time.

Example embodiments will now be described more fully with reference to the accompanying drawings. U.S. application Ser. No. 15/197,169, filed on Jun. 29, 2016, titled Maintenance and Diagnostics for Refrigeration Systems, is incorporated herein by reference in its entirety.

The present disclosure relates to systems and methods for liquid slugging detection and protection of compressors. The present disclosure monitors a rate of change of compressor temperature during compressor operation and shuts down the compressor when the rate of change of compressor temperature indicates presence of an unsafe slugging condition. The compressor is subsequently restarted using a bump-start procedure to clear the liquid from the sump or suction line.

As explained below in detail, when a negative rate of change of compressor temperature is detected, a function of a compressor's temperature profile (e.g., temperature gradient) is integrated, and the integrated value of the function is compared to a threshold to determine whether to shut down the compressor. The systems and methods of the present disclosure do not require knowledge of system conditions (e.g., suction superheat or system pressures) but one or more of the threshold and the terms of the integration function can be adjusted based on a minimum allowable discharge temperature if available to prevent nuisance shut-downs.

Additionally, feedback from the compressor regarding the effectiveness of the protection can be used to adjust one or more terms (e.g., constants) of the integration function and/or the threshold to increase the effectiveness of the protection. Further, if the compressor is a variable capacity compressor, the compressor may be advantageously operated in a lower than normal capacity during all or part of the bump-start procedure to clear the liquid from the sump or suction line. These and other features of the present disclosure are explained below in detail.

The present disclosure is organized as follows. First, an overview of the invention is presented with reference to FIG. 1. Then an example refrigeration system is described with reference to FIG. 2. Subsequently, the systems and methods for liquid slug detection and protection for the refrigeration system are described with reference to FIGS. 3-8.

While controlled liquid injection may be advantageously used for cooling and modulating capacity of compressors, unintentional introduction of liquid refrigerant into a compressor can significantly degrade the reliability of the compressor. Determination of a likelihood of having liquid refrigerant in the suction gas of a compressor (flood-back) is often done by determining a degree of superheat in the suction gas or by using a discharge gas temperature to determine the suction gas condition. While the suction superheat method does not easily portray the quality of the return gas if the value is less than 1, the discharge temperature method can provide some insight into the degree of severity of the flooding condition. Knowing a relative rate of liquid refrigerant return is important for determining an appropriate course of action to protect the compressor.

While continuous flooding at a low rate may eventually lead to reduced oil viscosity and associated bearing lubrication issues, ring wear, or other lubrication-type failures, the response time to protect against this problem is relatively long. A higher rate of liquid ingestion increases the risk of damage due to lubrication issues but also (and perhaps more importantly) due to the increased risk of damage from high pressures associated with the compression of liquid.

The present disclosure uses the rate of temperature change from sensor inputs to obtain an indication regarding the severity of the liquid slug. The present disclosure also includes provisions for protecting the compressor by turning it off and restarting with a bump-start procedure. The bump-start procedure is an optional feature that provides additional flooded-start protection. The bump-start procedure drives refrigerant out of the oil, preventing the refrigerant from circulating through the compressor as a liquid and washing the oil film off of the load-bearing surfaces. When the bump-start feature is enabled, the compressor is turned on for a few seconds (e.g., 2 seconds), then turned off for a few seconds (e.g., 5 seconds), and this process is repeated a few times (e.g., 3 times) before the compressor runs normally. This process allows refrigerant to exit the compressor without the oil being removed. An example of a bump-start system and method is described in detail in U.S. Pat. No. 9,194,393 issued on Nov. 24, 2015 assigned to Emerson Climate Technologies, Inc., which is incorporated herein by reference in its entirety.

The following terms are used in the present disclosure.

Quality—Mass ratio of gaseous refrigerant to the total (gas+liquid refrigerant) in the return (suction) fluid to a compressor. Quality of 1=no liquid refrigerant.

Slug—A quantity of liquid that is generally moving with the suction gas flow in the suction line of a compressor, ultimately entering the compressor. A slug generally refers to a condition whereby the bulk density of the suction flow is rapidly increasing due to larger volumetric percentages of liquid. This event is often associated with the termination of a defrost cycle, and is hence called a defrost protection routine (although defrost termination may not be the sole cause of this phenomenon).

Flood-back—A quality of suction refrigerant less than 1 (i.e., some continuous return of liquid). This term describes a less rapidly changing scenario than when a compressor is slugged.

DLT—discharge line temperature. Ideally, this is the discharge port, head or top-cap temperature of a compressor.

dT/dt—Rate of change of temperature with respect to time.

The present disclosure utilizes an inverse time algorithm to determine when to declare an unsafe slugging condition. A response to the unsafe slugging condition is to turn off the compressor and then initiate a bump-start procedure to clear the liquid out of the suction line and/or compressor. Constants used in the algorithm may be adjusted to accommodate different compressor platforms that have different liquid sensitivities, sensor response times, or sensor location changes. If the system monitoring the sensor(s) and running the algorithm detects an unsafe condition, the system may take advantage of any communication network or on-board display capability to annunciate that the compressor has been turned off due to slugging and is initiating the liquid clearing procedure.

FIG. 1 shows the inverse-time algorithm, triggered by a negative rate of discharge temperature versus time. The temperature may be sensed by a probe in the compressor at the discharge port, in the discharge line, or in the head, for example. The algorithm is triggered by a temperature slope, and the rate at which the integration parameter accumulates depends upon the rate of change. If the parameter (the integrated or accumulated value) exceeds a limit (a predetermined threshold), the compressor is turned off.

The algorithm includes the following equations:

$$G(t) = TMS * \left\{ \frac{c}{\left[\frac{\delta}{\delta_s}\right]^{\alpha} - 1} + \beta \right\} \quad \text{(Eq. 1)}$$

$$\int_0^T \frac{1}{G(t)}\, dt = \text{parameter} \quad \text{(Eq. 2)}$$

$$\int_0^{T_o} \frac{1}{G(t)}\, dt = \text{parameter limit} \quad \text{(Eq 3)}$$

In Eq. 1, the term G(t) denotes an operating compressor temperature gradient function that may indicate a slugging condition. The term TMS denotes a time multiplier setting factor. The terms C and β each denotes an inverse characteristic constant. The term α denotes an inverse characteristic exponent. The terms C, β, and α set the inverse time type. The term δ denotes the rate of change of compressor temperature dT/dt. The term $\delta_s$ denotes a negative rate of change (or temperature slope) used to turn on (i.e., trigger) the algorithm.

In Eq. 2, the term T denotes operating time since the integration began. Eq. 2 denotes the integration of the function 1/G(t) over time T. The term parameter on the right hand side of Eq. 2 is the value of the integral at any time T. In Eq. 3, the value of the integral at time $T_o$ is the parameter limit. The parameter limit is a pre-determined threshold which defines when the compressor will be tripped (turned off). As will be explained below, these terms can be adjusted based on a minimum allowable discharge temperature if available and feedback from the compressor regarding the effectiveness of the protection if available.

The term inverse time describes a relationship where the greater the deviation in the error in a term from the target, the faster the term integrates. In other words, if the goal is to correct a term to fix a problem, the corrective action is accelerated the further the term is from the target point. In FIG. 1, a value of rate of change of temperature ($\delta_s$) is used as a trigger point to turn on the integration function. When turned on, the term 1/G(t) is integrated over $T_o$. When the summation (i.e., the result of the integration) reaches (i.e., becomes greater than or equal to) the target point (i.e., the predetermined threshold or parameter limit in Eq. 3), the corrective action taken is to turn off the compressor and provide a recovery process (e.g., restarting the compressor using a bump-start procedure). Accordingly, the further the value of the negative rate of change of temperature δ is from the target trigger slope $\delta_s$ (i.e., the faster the compressor temperature is decreasing), the faster the result of the integration will sum up to the threshold value, and the faster the algorithm reaches the shutdown point. As will be described in detail below, additional actions may be taken to mitigate the immediate effects of the floodback event and to reduce the significance of repeated floodback events through system learning processes.

The algorithm can operate standalone without any knowledge of system conditions (e.g., suction superheat or system pressures). The algorithm operates with the assumption regarding what the superheat is before the flood-back event occurs. The assumption depends on the application. For example, a 50° F. (° F.=degree Fahrenheit) superheat may be a reasonable assumption for many refrigeration systems.

The algorithm can be enhanced using information regarding a minimum allowable discharge temperature, which represents 0° F. suction superheat (i.e., a temperature that will be developed by a compressor if the compressor is running with no superheat in the suction gas). This information, if available, is incorporated into the algorithm (by considering the difference between actual and minimum allowable compressor temperature) to adjust the parameter limit used by the algorithm to decide when to shut down the compressor and can therefore provide improved protection and/or prevent nuisance shut-downs.

Knowledge of system conditions (e.g., refrigerant type, compressor efficiency, system pressures) is required to generate a minimum allowable discharge temperature. Other factors that may be considered include whether liquid injection is being used for cooling and modulating the capacity of the compressor. A remote controller may preferably calculate the minimum allowable discharge temperature and provide it to a compressor-based controller that may preferably implement the algorithm for flood-back protection, where real-time compressor temperature is available.

One embodiment utilizes a bit (e.g., a flag) that is set true at the compressor controller to indicate that the next start will be a bump-start to clear the liquid. The advantage of the bit is that its state can be set by either the compressor controller or by the remote controller. If the remote controller determines that a bump start is warranted for other purposes, the remote controller can set the bit to true even if the compressor controller does not detect a flood-back event requiring a bump-start. Additionally, communication of the bit's state can inform the remote controller to expect a bump-start.

Thus, the inverse time algorithm to protect against rapid transient flood-back event can operate standalone without knowledge of system condition or can use (if available) the minimum allowable discharge temperature. Recovering from the event is best accomplished with a bump-start that can be triggered for other purposes by setting a bit true by either the compressor controller or the remote controller.

These embodiments assume that feedback regarding the effectiveness of the protection is unavailable from the compressor. The feedback, if available, can be used to adjust the algorithm's threshold. For example, the algorithm can include an adjustment factor that is incremented each time the feedback indicates insufficient protection. This factor could be applied to the threshold or a time multiplier constant used in the algorithm. Examples of the feedback include the following.

For example, the feedback may be available from a knock sensor (piezoelectric transducer), indirectly indicating high cylinder pressure by sensing compressor acceleration caused by excessive liquid entering the cylinder. In another example, the feedback may be in the form of a temperature measurement of the lubricant sump. Other examples of the feedback may include variations in the amperage of the compressor motor or power consumption of the compressor, indicating liquid entering the compression chamber of the compressor.

While the discharge temperature may be a preferred sensor input for the algorithm, the rate of change of temperature from a sensor on the suction side of the compressor can also be effective. For example, this sensor can be a motor temperature sensor (e.g., a Negative Temperature Coefficient (NTC) thermistor or a Resistance Temperature Detector (RTD)), a suction line sensor (e.g., a clip-on external sensor), or a sensor inside the compressor measuring the gas temperature as it enters the compressor.

Adjustments to the algorithm's constants may be made to account for the differences in the sensor's location and the characteristics of the compressor. For example, compressors that are refrigerant-cooled and have suction gas flowing through the motor may have more reserve thermal energy to flash the liquid than a directed suction gas compressor that must respond quickly to prevent mechanical damage. This can be accounted for by adjusting the algorithm's constants. In the suction-side approach, however, the signal strength may be low if the superheat is low.

Additionally, many variable-capacity compressors that utilize unloading (ability to reduce capacity) require a minimum differential pressure to activate the unloading mechanism. If the compressor has information regarding the system condition to determine that adequate differential pressure exists to activate an unloading device (e.g., blocked suction for a piston compressor), it may be advantageous to operate the compressor in the unloaded condition during all or part of the bump-start procedure to clear the liquid from the sump or suction line. This provides mechanical churning of the lubrication sump with reduced risk of swallowing liquid if liquid is in the sump. This process is particularly effective during a flooded start, where substantial amount of liquid refrigerant is in the sump of the compressor. If a small amount of refrigerant is in the sump, a bump-start procedure that incrementally clears the liquid from the suction line and the accumulator is preferred.

Further, a notification of the detection of liquid, even if the amount of liquid detected is not severe enough to warrant turning off the compressor, can be provided as part of the system's learning process to optimize the system's controls and settings for flood-back protection.

In sum, the present disclosure proposes a system and a method for detecting a potentially damaging rate of liquid ingestion into a running compressor and reacting to this indication to prevent mechanical damage to the compressor. The system and the method are based on the rate of change of compressor temperature. Also proposed are ways in which the effectiveness of the method can be enhanced if additional sensor inputs are available. These and other aspects of the present disclosure are now described in further detail.

Figure 2:
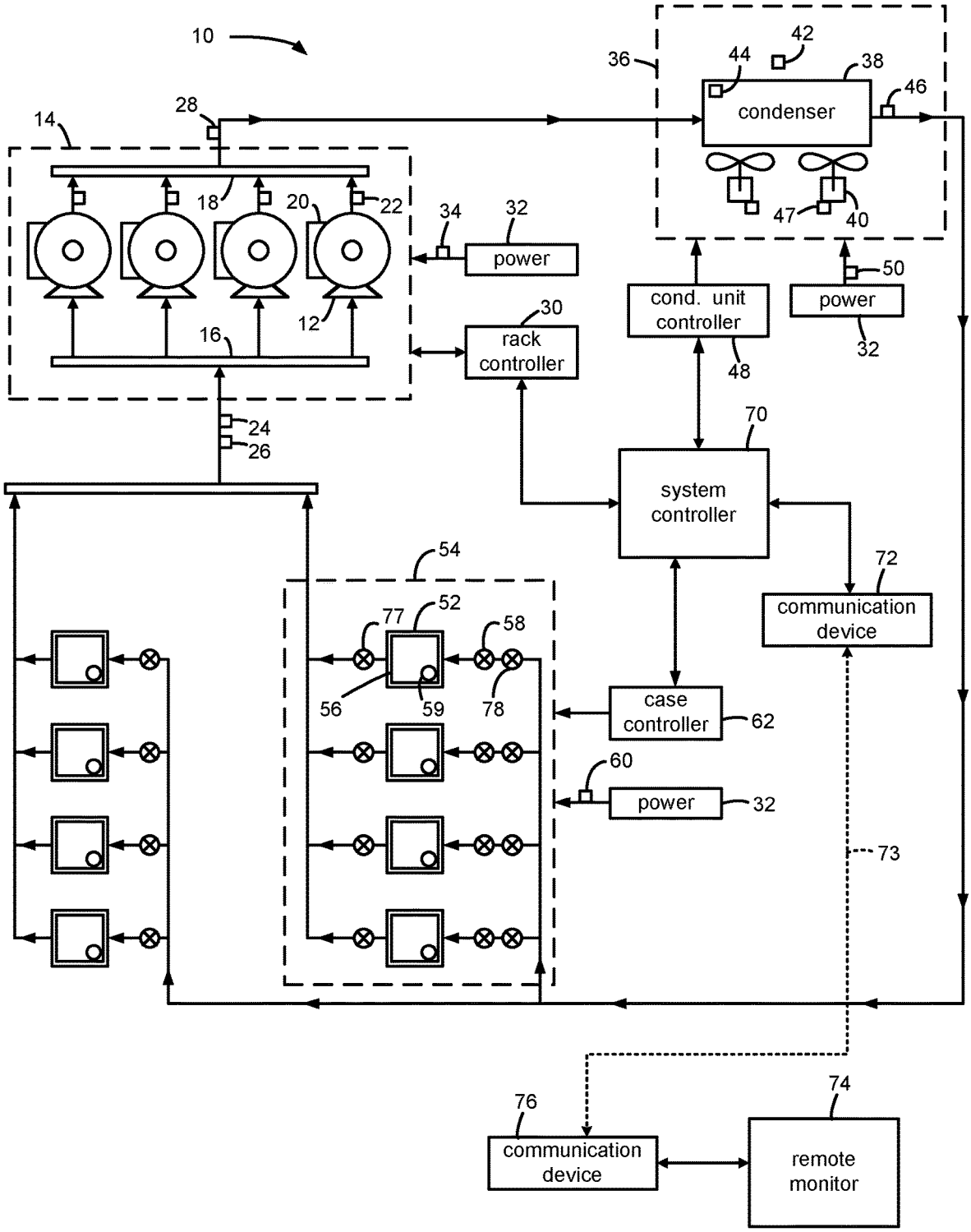
FIG. 2 is an example of a refrigeration system.

FIG. 2 shows an example of a refrigeration system 10 including a plurality of compressors 12 piped together in a compressor rack 14 with a common suction manifold 16 and a discharge header 18. While FIG. 2 shows an example refrigeration system 10, the teachings of the present disclosure also apply, for example, to HVAC systems.

Each compressor 12 has an associated compressor controller 20 that monitors and controls operation of the compressor 12. For example, the compressor controller 20 may monitor electric power, voltage, and/or current delivered to the compressor 12 with a power sensor, a voltage sensor, and/or a current sensor. Further, the compressor controller 20 may also monitor suction or discharge temperatures or pressures of the compressor 12 with suction or discharge temperature or pressure sensors. For example, a discharge outlet of each compressor 12 can include a respective discharge temperature sensor 22. A discharge pressure sensor can be used in addition to, or in place of, the discharge temperature sensor 22. An input to the suction manifold 16 can include both a suction pressure sensor 24 and a suction temperature sensor 26. Further, a discharge outlet of the discharge header 18 can include an associated discharge pressure sensor 28. A discharge temperature sensor can be used in addition to, or in place of, the discharge pressure sensor 28. As described in further detail below, the various sensors can be implemented for monitoring performance and diagnosing the compressors 12 in the compressor rack 14.

A rack controller 30 may monitor and control operation of the compressor rack 14 via communication with each of the compressor controllers 20. For example, the rack controller 30 may instruct individual compressors 12 to turn on or turn off through communication with the compressor controllers 20. Additionally, the rack controller 30 may instruct variable capacity compressors to increase or decrease capacity through communication with the compressor controllers 20. In addition, the rack controller 30 may receive data indicating the electric power, voltage, and/or current delivered to each of the compressors 12 from the compressor controllers 20. Further, the rack controller 30 may also receive data indicating the suction or discharge temperatures or pressures of each of the compressors 12 from the compressor controllers 20. Additionally or alternatively, the rack controller 30 may communicate directly with the suction or discharge temperature or pressure sensors to receive such data. Additionally, the rack controller 30 may be in communication with other suction and discharge temperature and pressure sensors, including, for example, discharge pressure sensor 28, suction pressure sensor 24, and suction temperature sensor 26.

Electric power may be delivered to the compressor rack 14 from a power supply 32 for distribution to the individual compressors 12. A rack power sensor 34 may sense the amount of power delivered to the compressor rack 14. A current sensor or a voltage sensor may be used in place of or in addition to the power sensor 34. The rack controller 30 may communicate with the rack power sensor 34 and monitor the amount of power delivered to the compressor rack 14. Alternatively, the rack power sensor 34 may be omitted and the total power delivered to the compressor rack 14 may be determined based on the power data for the power delivered to each of the individual compressors 12 as determined by the compressor controllers 20.

The compressor rack 14 compresses refrigerant vapor that is delivered to a condensing unit 36 having a condenser 38 where the refrigerant vapor is liquefied at high pressure. Condenser fans 40 may enable improved heat transfer from the condenser 38. The condensing unit 36 can include an associated ambient temperature sensor 42, a condenser temperature sensor 44, and/or a condenser discharge pressure sensor 46. Each of the condenser fans 40 may include a condenser fan power sensor 47 that senses the amount of power delivered to each of the condenser fans 40. A current sensor or a voltage sensor may be used in place of or in addition to the condenser fan power sensor 47.

A condensing unit controller 48 may monitor and control operation of the condenser fans 40. For example, the condensing unit controller 48 may turn on or turn off individual condenser fans 40 and/or increase or decrease capacity of any variable speed condenser fans 40. In addition, the condensing unit controller 48 may receive data indicating the electric power delivered to each of the condenser fans 40 through communication with the condenser fan power sensors 47. Additionally, the condensing unit controller 48 may be in communication with the other condensing unit sensors, including, for example, the ambient temperature sensor 42, the condenser temperature sensor 44, and the condenser discharge pressure sensor 46.

Electric power may be delivered to the condensing unit 36 from the power supply 32 for distribution to the individual condenser fans 40. A condensing unit power sensor 50 may sense the amount of power delivered to the condensing unit 36. A current sensor or a voltage sensor may be used in place of or in addition to the condensing unit power sensor 50. The condensing unit controller 48 may communicate with the condensing unit power sensor 50 and monitor the amount of power delivered to the condensing unit 36.

The high-pressure liquid refrigerant from the condensing unit 36 may be delivered to refrigeration cases 52. For example, refrigeration cases 52 may include a group 54 of refrigeration cases 52. The refrigeration cases 52 may be refrigerated or frozen food cases at a grocery store, for example. Each refrigeration case 52 may include an evaporator 56 and an expansion valve 58 for controlling the superheat of the refrigerant and an evaporator temperature sensor 59. The refrigerant passes through the expansion valve 58 where a pressure drop causes the high pressure liquid refrigerant to achieve a lower pressure combination of liquid and vapor. As hot air from the refrigeration case 52 moves across the evaporator 56, the low pressure liquid turns into gas. The low pressure gas is then delivered back to the compressor rack 14, where the refrigeration cycle starts again.

A case controller 62 may monitor and control operation of the evaporators 56 and/or the expansion valves 58. For example, the case controller 62 may turn on or turn off evaporator fans of the evaporators 54 and/or increase or decrease capacity of any variable speed evaporator fans. The case controller 62 may be in communication with the evaporator temperature sensor 59 and receive evaporator temperature data.

Electric power may be delivered to the group 54 of refrigeration cases 52 from the power supply 32 for distribution to the individual condenser fans 40. A refrigeration case power sensor 60 may sense the amount of power delivered to the group 54 of refrigeration cases 52. A current sensor or a voltage sensor may be used in place of or in addition to the refrigeration case power sensor 60. The case controller 62 may communicate with the refrigeration case power sensor 60 and monitor the amount of power delivered to the group 54 of refrigeration cases 52.

As discussed above, while FIG. 2 shows an example refrigeration system 10, the teachings of the present disclosure also apply, for example, to HVAC systems, including, for example, air conditioning and heat pump systems. In the example of an HVAC system, the evaporators 56 would be installed in air handler units instead of in refrigeration cases 52.

A system controller 70 monitors and controls operation of the entire refrigeration system 10 through communication with each of the rack controller 30, condensing unit controller 48, and the case controller 62. Alternatively, the rack controller 30, condensing unit controller 48, and/or case controller 62 could be omitted and the system controller 70 could directly control the compressor rack 14, condensing unit 36, and/or group 54 of refrigeration cases 52. The system controller 70 can receive the operation data of the refrigeration system 10, as sensed by the various sensors, through communication with the rack controller 30, condensing unit controller 48, and/or case controller 62. For example, the system controller can receive data regarding the various temperatures and pressures of the system and regarding electric power, current, and/or voltage delivered to the various system components. Alternatively, some or all of the various sensors may be configured to communicate directly with the system controller 70. For example, the ambient temperature sensor 42 may communicate directly with the system controller 70 and provide ambient temperature data.

The system controller 70 may coordinate operation of the refrigeration system, for example, by increasing or decreasing capacity of various system components. For example, the system controller 70 may instruct the rack controller 30 to increase or decrease capacity by activating or deactivating a compressor 12 or by increasing or decreasing capacity of a variable capacity compressor 12. The system controller 70 may instruct the condensing unit controller 48 to increase or decrease condensing unit capacity by activating or deactivating a condenser fan 40 or by increasing or decreasing a speed of a variable speed condenser fan 40. The system controller 70 may instruct the case controller 62 to increase or decrease evaporator capacity by activating or deactivating an evaporator fan of an evaporator 56 or by increasing or decreasing a speed of a variable speed evaporator fan. The system controller 70 may include a computer-readable medium, such as a volatile or nonvolatile memory, to store instructions executable by a processor to carry out the functionality described herein to monitor and control operation of the refrigeration system 10.

The system controller 70 may be, for example, an E2 RX refrigeration controller available from Emerson Climate Technologies Retail Solutions, Inc. of Kennesaw, Ga. If the system is an HVAC system instead of a refrigeration system, the system controller 70 may be, for example, an E2 BX HVAC and lighting controller also available from Emerson Climate Technologies Retail Solutions, Inc. of Kennesaw, Ga. Further, any other type of programmable controller that may be programmed with the functionality described in the present disclosure can also be used.

The system controller 70 may be in communication with a communication device 72. The communication device 72 may include, for example, a desktop computer, a laptop, a tablet, a smartphone, or other computing device with communication/networking capabilities. The communication device 72 may communicate with the system controller 70 via a local area network (LAN) at the facility location of the refrigeration system 10. The communication device 72 may also communicate with the system controller 70 via a wide area network (WAN), such as the Internet. The communication device 72 may communicate with the system controller 70 to receive and view operational data of the refrigeration system 10, including, for example, energy or performance data for the refrigeration system 10.

The system controller 70 may also communicate with a remote monitor (or a remote controller) 74 via, for example, a wide area network, such as the internet, or via phone lines, cellular, and/or satellite communication (shown at 73). The remote monitor 74 may communicate with multiple system controllers 70 associated with multiple refrigeration or HVAC systems. The remote monitor 74 may also be accessible to a communication device 76, such as a desktop computer, a laptop, a tablet, a smartphone, or other computing device with communication/networking capabilities. The communication device 76 may communicate with the remote monitor 74 to receive and view operational data for one or more refrigeration or HVAC systems, including, for example, energy or performance data for the refrigeration or HVAC systems.

The system controller 70 can monitor the actual power consumption of the refrigeration system 10, including the compressor rack 14, the condensing unit 36, and the refrigeration cases 52, and compare the actual power consumption of the refrigeration system 10 with a predicted power consumption or with a benchmark power consumption for the refrigeration system 10 to determine a health indicator score for the refrigeration system 10 and/or for individual refrigeration system components. Additionally or alternatively, the system controller 70 can monitor the temperatures and pressures of the refrigeration system 10, including the compressor rack 14, the condensing unit 36, and the refrigeration cases 52, and compare the temperatures and/or pressures with expected temperatures and/or pressures, based, for example, on historical data to determine a health indicator score for the refrigeration system 10 and/or for individual refrigeration system components.

In some embodiments, the refrigeration system 10 may not include the compressor rack 14 if the refrigeration system 10 includes a single compressor 12. If the refrigeration system 10 includes a single compressor 12, the functions and operations described with reference to the rack controller 30 and the system controller 70 may be performed by the compressor controller 20 of the single compressor 12.

Figure 3:
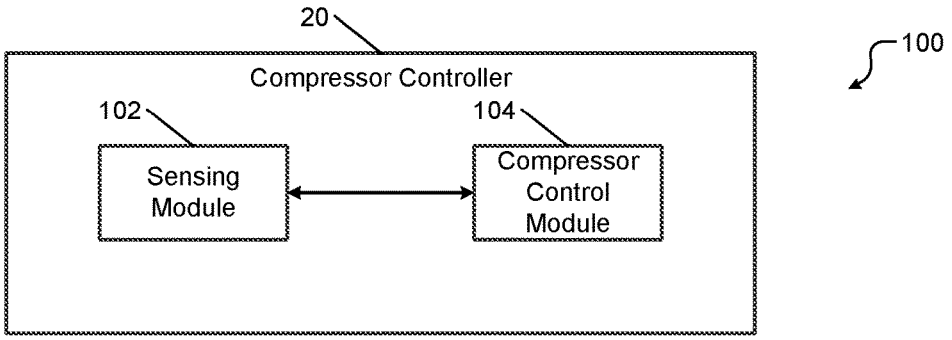
FIG. 3 is a functional block diagram of a system for liquid slugging detection and providing liquid flood-back protection in compressors used in the refrigeration system of FIG. 2.

FIG. 3 shows a system 100 for liquid slugging detection and providing liquid flood-back protection in compressors (e.g., the compressors 12 in the compressor rack 14 shown in FIG. 2). The system 100 is implemented in the compressor controller 20. The compressor controller 20 comprises a sensing module 102 and a compressor control module 104.

The sensing module 102 may receive data from one or more sensors to sense one or more temperatures of the compressor 12. For example, the sensing module 102 may receive data from the discharge temperature sensor 22 and other temperature and pressure sensors associated with the compressor 12 that are described above with reference to FIG. 2.

The compressor control module 104 determines the rate of change of temperature and integrates a function of a temperature gradient of the compressor 12 based on the rate of change of temperature. Based on the result of the integration, the compressor control module 104 determines whether to shut down the compressor 12 and whether to subsequently restart the compressor 12.

Figure 4:
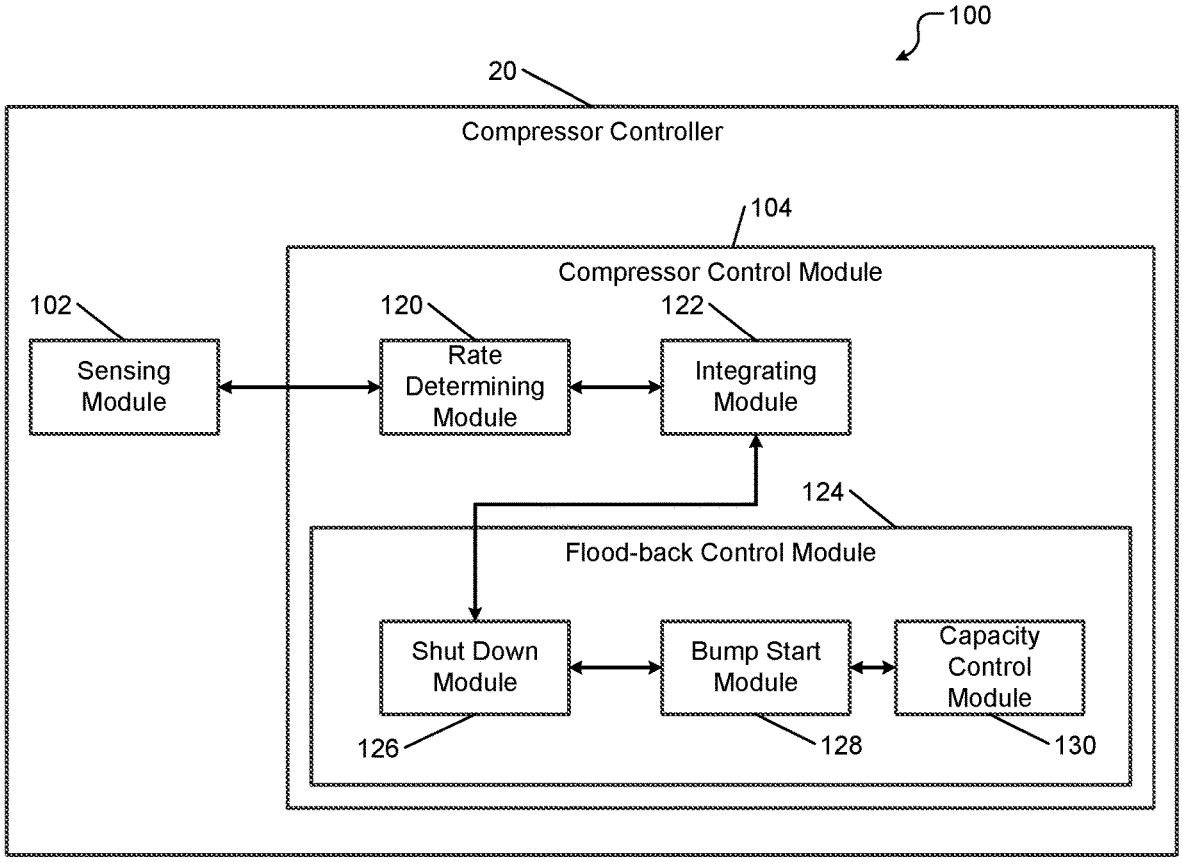
FIG. 4 is a detailed functional block diagram of the system of FIG. 3.

FIG. 4 shows the compressor control module 104 in further detail. The compressor control module 104 comprises a rate determining module 120, an integrating module 122, and a flood-back control module 124. The flood-back control module 124 comprises a shutdown module 126, a bump start module 128, and a capacity control module 130.

The rate determining module 120 determines the rate of change of temperature (e.g., the discharge temperature of the compressor 12). The integrating module 122 integrates the temperature gradient function of the compressor 12 based on the rate of change of temperature. For example, the integrating module 122 integrates the function when the rate of change of temperature is less than a predetermined negative rate $\delta_s$ as shown in FIG. 1. The integrating module 122 determines whether the result of the integration (i.e., the accumulated value) exceeds a predetermined threshold. If the result of the integration exceeds the predetermined threshold, the shutdown module 126 shuts down the compressor 12, and the bump start module 128 subsequently restarts the compressor 12 using a bump-start procedure.

The capacity control module 130 may decrease the capacity of the compressor 12 during all of part of the bump-start. This provides mechanical churning of the lubrication sump with reduced risk of swallowing liquid if liquid is in the sump. This process is particularly effective during a flooded start, where substantial amount of liquid refrigerant is in the sump of the compressor 12. If a small amount of refrigerant is in the sump, a bump-start procedure that incrementally clears the liquid from the suction line and the accumulator is preferred.

If the result of the integration does not exceed the predetermined threshold but is greater than zero, the shutdown module 126 does not shut down the compressor 12, and the bump start module 128 does not restart the compressor 12 using the bump-start procedure. However, if the result of the integration does not exceed the predetermined threshold but is greater than zero, the compressor control module 104 may issue a warning message indicating presence of some (but not severe) amount of liquid within the compressor 12. The compressor control module 104 can perform the above operations without knowledge of system conditions. Communication of the parameter values during the integration may be used as part of the system feedback and learning for valve adjustments to prevent future occurrences. Or, these adjustments may be made in the system in an effort to immediately mitigate the floodback severity.

In FIG. 2, upon communication of a floodback event, system reaction to mitigate the effects of the floodback may be to throttle the evaporator pressure regulator valve 77 on the offending evaporator, or to adjust the expansion valve 58, or to pulse the liquid solenoid valve 78 in order to slow the flow of liquid refrigerant out of the evaporator. Other actions may include reducing the compressor speed, if it is a variable speed compressor, partially or wholly unloading the compressor, or a combination of these actions. The results of these actions may also be input into a learning process for preventing or reducing the magnitude of the problem in the future. For instance, the system may apply a machine learning algorithm to discover that pulsing the liquid solenoid for a particular duty cycle and duration (or acting on the other options) allows the compressor(s) to run without reaching the parameter limit or to perhaps avoid triggering the algorithm altogether. Continuing to incorporate these actions into repeated system actions (e.g., scheduled defrost cycles) mitigates future problems.

While the discharge temperature may be a preferred sensor input for the algorithm, the rate of change of temperature from a sensor on the suction side of the compressor can also be effective. For example, this sensor can be a motor temperature sensor (e.g., a Negative Temperature Coefficient (NTC) thermistor or a Resistance Temperature Detector (RTD)), a suction line sensor (e.g., a clip-on external sensor), or a sensor inside the compressor measuring the gas temperature as it enters the compressor. The sensing module 102 can receive data from these other sensors.

The compressor control module 104 may adjust the algorithm's constants to account for the differences in the sensor's location and the characteristics of the compressors. For example, compressors that are refrigerant-cooled and have suction gas flowing through the motor may have more reserve thermal energy to flash the liquid than a directed suction gas compressor that must respond quickly to prevent mechanical damage. This can be accounted for by adjusting the algorithm's constants.

While it is desirable for the discharge temperature probe to be in the gas stream and close to the discharge port, it is not practical in all scenarios (e.g., hermetic compressors or field retrofit scenarios) to do this. In such applications, externally mounted sensors may be attached to the discharge line of the compressor. Adjustment of the algorithm's constants to accommodate resulting temperature shifts or response time differences is also very probable in these cases. Control module 104 may adjust the constants (e.g., triggered by a switch setting or programmable selection during set-up) so that an externally mounted sensor with a slower response time would have a lower magnitude of trigger slope (to initiate an integration procedure). If there is a temperature shift between the discharge port and the probe location, this offset is taken into account when the parameter limit is established if the minimum allowable discharge temperature information is available.

Figure 5:
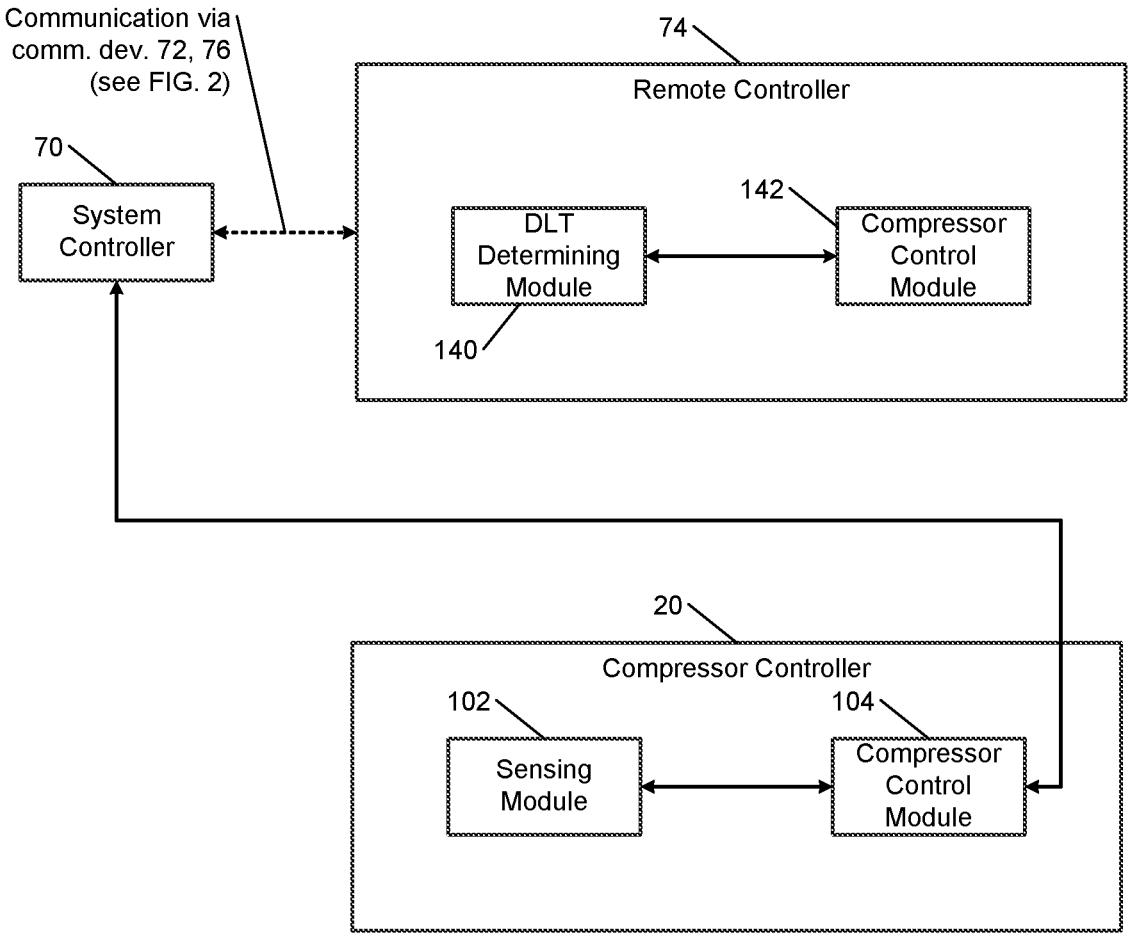
FIG. 5 shows the system of FIG. 3 communicating with a remote controller.

FIG. 5 shows the operation of the compressor control module 104 when minimum allowable discharge temperature data is available from the remote controller 74 (shown as remote monitor 74 in FIG. 2). The remote controller 74 communicates with the system controller 70 via the communication devices 72, 76 shown in FIG. 2. The system controller 70 communicates with the compressor controller 20. The remote controller 74 receives system information regarding the compressor 12 from the system controller 70. The remote controller 74 calculates the minimum allowable discharge temperature based on the received system information regarding the compressor 12 from the system controller 70. The remote controller 74 sends the minimum allowable discharge temperature to the system controller 70. The compressor control module 104 utilizes the minimum allowable discharge temperature data received from the remote controller 74 to improve (fine tune) the algorithm and/or to avoid nuisance trips.

The remote controller 74 comprises a discharge line temperature (DLT) determining module 140 and a compressor control module 142. The DLT determining module 140 receives a plurality of operating parameters of the compressor 12 during the operation of the compressor 12. For example, the DLT determining module 140 periodically receives the plurality of operating parameters from the system controller 70 (or the compressor controller 20). For example, the plurality of operating parameters of the compressor 12 may include but are not limited to a discharge pressure, a suction pressure, and a return gas temperature of the compressor 12. The plurality of operating parameters of the compressor 12 may also include performance data of the compressor 12 and properties of a refrigerant used in the compressor 12. The plurality of operating parameters of the compressor 12 may further include whether liquid injection is employed in the compressor 12. Based on the plurality of operating parameters, the DLT determining module 140 determines a minimum discharge line temperature of the compressor 12. The minimum discharge line temperature represents a discharge line temperature corresponding to (for example) refrigerant entering the compressor 12 with 0° superheat, and a quality of 1. A wet suction quality (quality<1) may also be used for determining a minimum allowable discharge temperature.

The compressor control module 142 in the remote controller 74 may control various aspects of the compressor 12 including whether to shut down the compressor 12 (e.g., for reasons other than flood-back), whether to modulate the capacity of the compressor 12, and so on. For example, the compressor control module 142 in the remote controller 74 may set a bit that the compressor controller 20 checks to decide whether to shut down the compressor 12 even in the absence of a flood-back condition occurring in the compressor 12.

When the compressor control module 104 in the compressor controller 20 receives the minimum discharge line temperature of the compressor 12 from the remote controller 74, the compressor control module 104 may adjust the algorithm's threshold based on a difference between the present discharge line temperature of the compressor 12 and the minimum discharge line temperature of the compressor 12. Adjusting the algorithm's threshold based on the minimum discharge line temperature of the compressor 12 can improve the decision making capability of the algorithm regarding when to shut down the compressor 12 in response to the rate of change of the compressor temperature. Adjusting the algorithm's threshold based on the minimum discharge line temperature of the compressor 12 can prevent nuisance trips.

The system controller 70 (or the compressor controller 20) sends feedback to the remote controller 74 regarding the actions performed on the compressor 12 and the status of the compressor 12 (e.g., whether the compressor 12 will be restarted using bump-start, whether the compressor 12 will be operated at a lower than normal capacity during bump-start, and so on). In some embodiments, the minimum DLT may be determined in the compressor controller 20 (or in the system controller 70).

Figure 6:
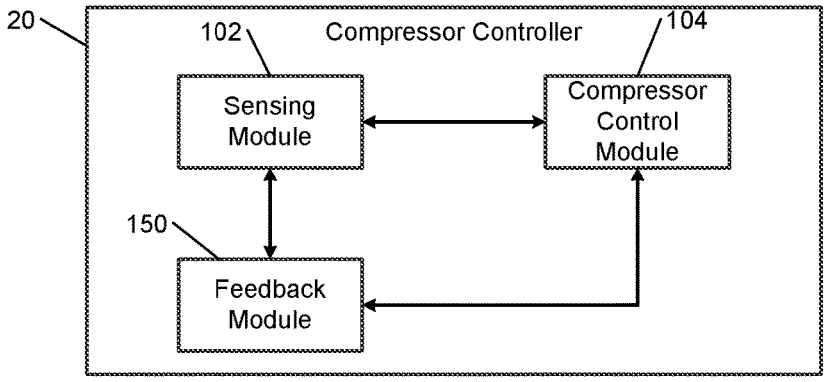
FIG. 6 shows the system of FIG. 3 utilizing feedback regarding effectiveness of the protection provided by the system.

FIG. 6 shows the operation of the compressor control module 104 when feedback regarding the effectiveness of the protection is available from the compressor 12. The compressor controller 20 further comprises a feedback module 150 that receives feedback information from the compressor 12. The compressor control module 104 may use the feedback to adjust the algorithm's threshold. For example, the algorithm can include an adjustment factor that is incremented each time the feedback indicates insufficient protection. This factor could be applied to the threshold or a time multiplier constant used in the algorithm.

For example, the feedback module 150 may receive feedback including but not limited to the following. For example, the feedback may be available from an accelerometer such as a "knock sensor", indicating high cylinder pressure from excessive liquid entering the cylinder. Knock sensors are piezoelectric transducers and are sensitive to acceleration in the axial direction of the transducer. The sensor should be mounted accordingly to pick up the dominant acceleration direction during a flood-back event. High cylinder pressure in a reciprocating compressor manifests itself as an angular acceleration (although not exclusively due to coupling) about the crank centerline. Mounting the accelerometer perpendicular to a cylinder bank plane which intercepts the centerline is often an effective location to choose. Knock sensors are of two general varieties. A "flat response" (non-resonant) type sensor may be easier to apply across a variety of compressors because it can detect vibration across a wider frequency range. Conventional (resonant) type transducers are selected to have resonant frequencies near the predominant knock frequency.

In another example, the feedback may be in the form of a temperature measurement of the lubricant sump, and especially monitoring the difference between the sump and the saturated suction temperature. Other examples of the feedback may include variations in the amperage of the compressor motor or power consumption of the compressor, indicating liquid entering the compression chamber of the compressor. The sensing module 102 may receive data from one or more of these sensors. The feedback module 150 may process the data and provide the feedback to the compressor control module 104 for local action such as unloading of the compressor. Any of the feedback information may be incorporated into the communication data providing external feedback to the rack controller 30 or the system controller 70. This information may be incorporated into the machine learning processes for development of valve actions and timing to mitigate repeating flood-back events.

While FIG. 5 does not show the feedback module 150, the compressor controller 20 of FIG. 5 may additionally comprise the feedback module 150. Further, while not shown in FIG. 6, the compressor controller 20 of FIG. 6 may additionally receive the minimum discharge line temperature of the compressor 12 from the remote controller 74. Accordingly, the embodiments shown in FIGS. 5 and 6 may not be disjoint. Rather, the embodiments shown in FIGS. 5 and 6 may be combined and operated together and are shown separately to describe their respective features in detail. Depending on application and implementation, the compressor controller 20 may receive the feedback from the compressor 12 in addition to or instead of receiving the minimum discharge line temperature of the compressor 12 from the remote controller 74. Accordingly, depending on the application and implementation, the compressor controller 20 may receive one or more of the feedback from the compressor 12 and the minimum DLT of the compressor 12 from the remote controller 74. In some implementations, the DLT determining module 140 may be included in the rack controller 30 or the system controller 70.

Figure 7:
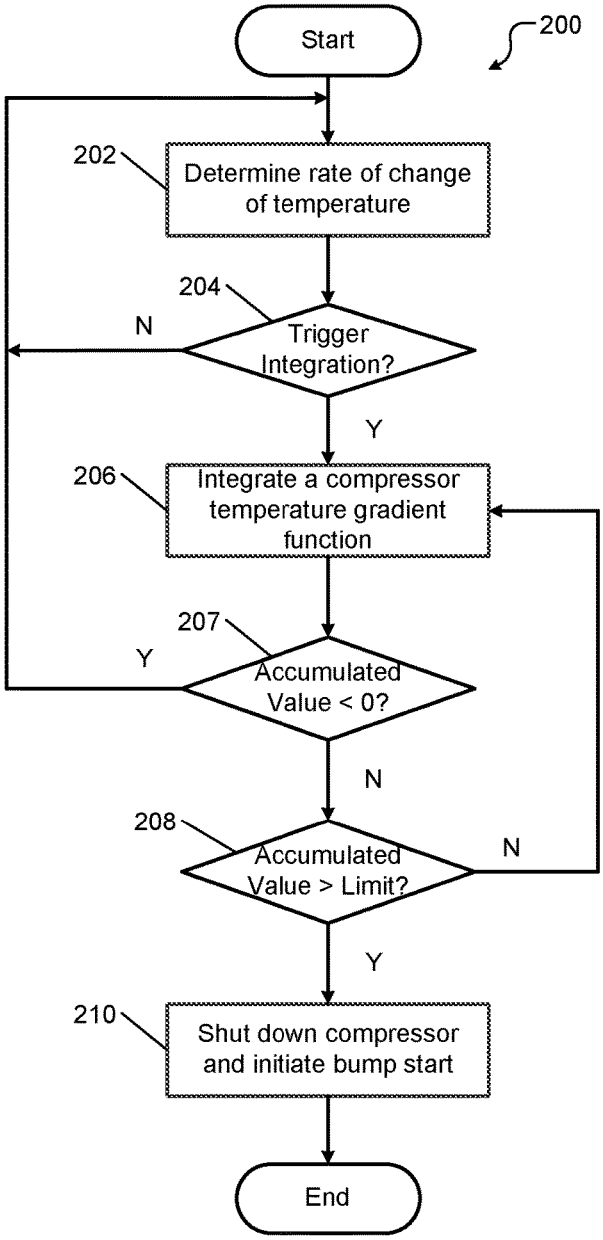
FIG. 7 is a flowchart of a method for liquid slugging detection and providing liquid flood-back protection in compressors used in the refrigeration system of FIG. 2.

FIG. 7 shows a method 200 for liquid slugging detection and providing liquid flood-back protection in compressors (e.g., the compressors 12 in the compressor rack 14 shown in FIG. 2). The method 200 is performed by the compressor controller 20 without knowledge of system conditions.

At 202, control determines a rate of change of compressor temperature (e.g., discharge temperature of the compressor). At 204, control determines whether to integrate a function of a discharge temperature gradient of the compressor based on the rate of change of compressor temperature. For example, control initiates the integration procedure if the rate of change of compressor temperature is less than or equal to the trigger slope $\delta_s$ ($dT/dt-\delta_s<=0$). Control returns to 202 if the rate of change of compressor temperature is greater than the trigger slope $\delta_s$ (more positive).

At 206, control integrates the function of the temperature gradient of the compressor. At 208, control determines whether the result of the integration procedure (i.e., accumulated value) is greater than or equal to a predetermined threshold. Control returns to 206 if the result of the integration procedure is not greater than or equal to the predetermined threshold. At 210, if the result of the integration procedure is greater than or equal to the predetermined threshold, control shuts down the compressor and subsequently restarts the compressor using a bump-start procedure. At 207, if during the integration process the value of the parameter is less than 0, control returns to 202. This occurs when the floodback situation resolves itself prior to a trip decision (i.e., a decision to shut down the compressor).

Figure 8:
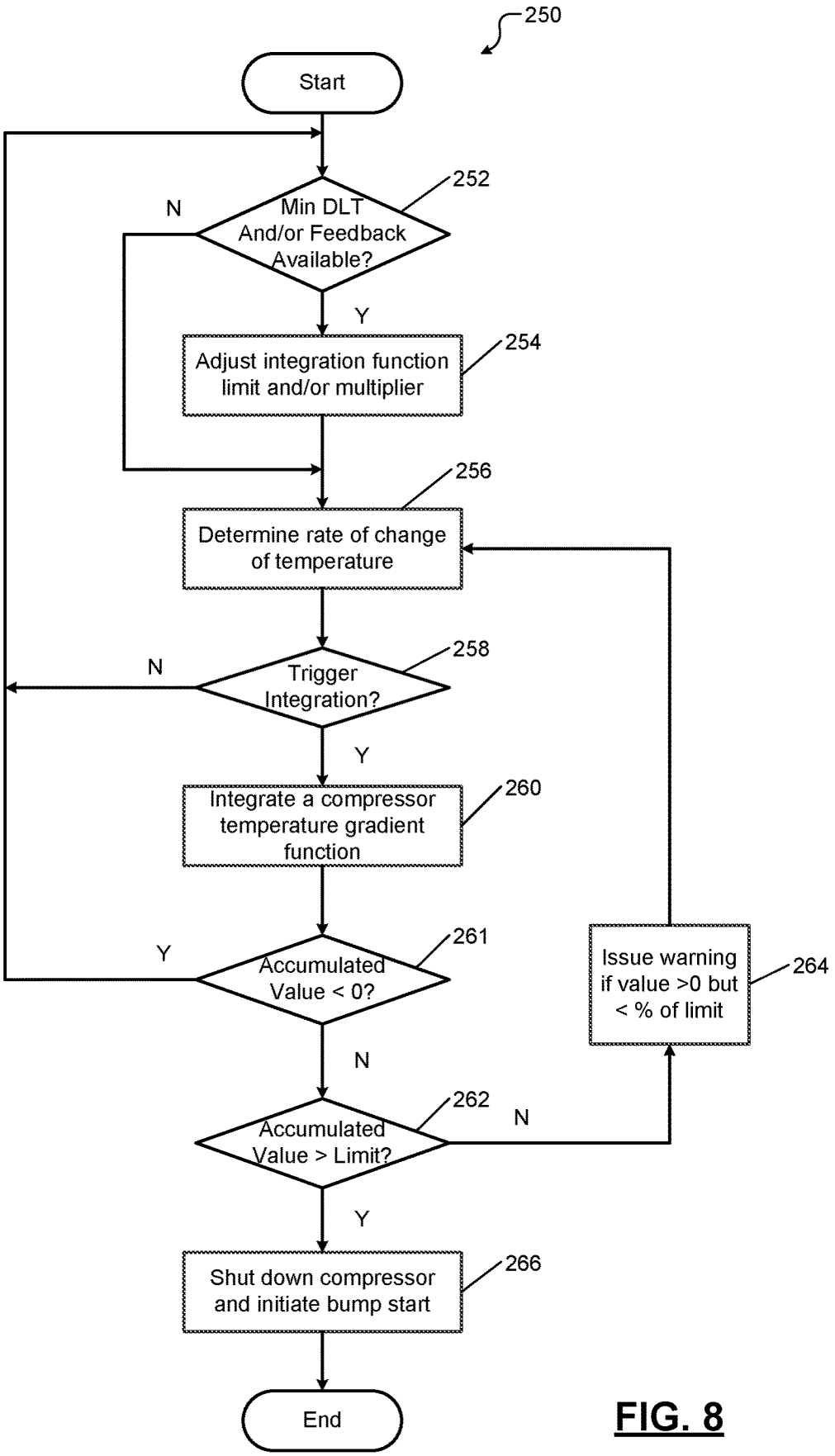
FIG. 8 is a flowchart of a method for liquid slugging detection and providing liquid flood-back protection in compressors utilizing one or more of a minimum allowable discharge temperature and feedback regarding effectiveness of the protection.

FIG. 8 shows a method 250 for liquid slugging detection and providing liquid flood-back protection in compressors (e.g., the compressors 12 in the compressor rack 14 shown in FIG. 2). The method 250 is performed by the compressor controller 20 when one or more of a minimum allowable discharge temperature of the compressor and feedback from the compressor regarding the effectiveness of the protection are available.

At 252, control determines whether one or more of a minimum allowable discharge temperature of the compressor and feedback from the compressor regarding the effectiveness of the protection are available. Control proceeds to 256 if one or more of a minimum allowable discharge temperature of the compressor and feedback from the compressor regarding the effectiveness of the protection are unavailable. At 254, if one or more of a minimum allowable discharge temperature of the compressor and feedback from the compressor regarding the effectiveness of the protection are available, control adjusts the threshold and/or one or more terms (e.g., multiplier, constants, and so on) of the integration function. Control uses the adjusted values in subsequent processing.

At 256, control determines a rate of change of compressor temperature (e.g., discharge temperature of the compressor). At 258, control determines whether to integrate a function of temperature gradient of the compressor based on the rate of change of compressor temperature. For example, control initiates the integration procedure if the rate of change of compressor temperature is less than or equal to the trigger slope $\delta_s$. Control returns to 252 if the rate of change of compressor temperature is greater than the trigger slope $\delta_s$.

At 260, having been triggered to do so, control integrates the temperature gradient function of the compressor. At 262, control determines whether the result of the integration procedure (i.e., accumulated value) is greater than or equal to a predetermined threshold. At 264, if the result of the integration procedure is not greater than or equal to the predetermined threshold but is greater than zero, control issues a warning message indicating presence of some (but not severe) amount of liquid within the compressor, and control returns to 256 for continued integration. At 266, if the result of the integration procedure is greater than or equal to the predetermined threshold, control shuts down the compressor and subsequently restarts the compressor using a bump-start procedure. At 261, if during the integration process the value of the parameter becomes less than 0, control returns to 252. This occurs when the floodback situation resolves itself prior to a trip decision (i.e., a decision to shut down the compressor).

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising:

a sensor to sense a temperature of a compressor of a refrigeration or HVAC system during operation of the compressor; and a controller for the refrigeration or HVAC system, the controller being configured to determine a rate of change of the temperature relative to time and to perform one or more procedures to protect the compressor based on the rate of change of the temperature, wherein the controller is further configured to, using an inverse time algorithm triggered by the rate of change of the temperature being negative, integrate a function of a temperature gradient of the compressor, wherein a value of the integrated function depends on the rate of change of the temperature, and shut down the compressor by comparing the value of the integrated function to a predetermined threshold, and to receive feedback from the compressor and adjust the predetermined threshold and one or more terms of the function based on the feedback.

2. The system of claim 1 wherein the one or more procedures to protect the compressor include shutting down the compressor, throttling a pressure regulator valve of an evaporator associated with the compressor, adjusting an expansion valve associated with the evaporator, reducing speed of the compressor, and partially or wholly unloading the compressor.

3. The system of claim 1 wherein the sensor senses the temperature at a discharge port of the compressor.

4. The system of claim 1 wherein the sensor senses the temperature at a suction port of the compressor.

5. The system of claim 1 wherein subsequent to shutting down the compressor, the controller is further configured to restart the compressor using a bump-start procedure after shutting down the compressor based on the rate of change of the temperature.

6. The system of claim 1 wherein the controller is further configured to shut down the compressor based on the rate of change of the temperature without knowledge of operating conditions of the compressor including suction superheat and suction and discharge pressures of the compressor.

7. The system of claim 1 wherein the controller is further configured to shut down the compressor based on the rate of change of the temperature by assuming a value of suction superheat before a flood-back event occurs.

8. The system of claim 1 wherein the controller is further configured to communicate with a remote controller and to shut down and restart the compressor using a bump-start procedure based on data received from the remote controller irrespective of whether the rate of change of the temperature indicates occurrence of a flood-back event requiring a shut down and restart of the compressor using the bump-start procedure.

9. The system of claim 5 wherein the compressor is a variable capacity compressor and wherein the controller is further configured to operate the compressor at a lower than normal capacity during at least a portion of the bump-start procedure.

10. The system of claim 1 wherein the controller is further configured to adjust the predetermined threshold based on a difference between the sensed temperature and a minimum discharge line temperature representing zero suction superheat or an acceptable wet suction quality limit and to shut down the compressor by comparing the value of the integrated function to the predetermined threshold adjusted based on the minimum discharge line temperature.

11. The system of claim 10 wherein the controller is further configured to receive from a remote controller the minimum discharge line temperature determined based on a plurality of operating parameters of the compressor including properties of refrigerant, efficiency of the compressor, and suction and discharge pressures of the compressor.

12. The system of claim 1 wherein the controller is further configured to adjust one or more terms of the function based on a location of the sensor relative to the compressor to account for a temperature shift or a response time difference caused based on the location of the sensor.

13. The system of claim 1 wherein:

the feedback is from a knock sensor indicating a change in cylinder pressure in the compressor based on an amount of liquid entering a cylinder of the compressor;

the feedback includes a temperature measurement of lubricant sump or a difference between the temperature measurement of lubricant sump and a saturated suction temperature; or the feedback includes a change in amperage of compressor motor or compressor power indicating liquid entering compression chamber of compressor.

14. A method comprising:

sensing, with a sensor, a temperature of a compressor of a refrigeration or HVAC system during operation of the compressor;

determining, with a controller, a rate of change of the temperature relative to time;

performing, with the controller, one or more procedures to protect the compressor based on the rate of change of the temperature;

in response to the rate of change of the temperature being negative, which triggers an inverse time algorithm, integrating using the inverse time algorithm, with the controller, a function of a temperature gradient of the compressor, wherein a value of the integrated function depends on the rate of change of the temperature, and shutting down the compressor by comparing the value of the integrated function to a predetermined threshold; and receiving, with the controller, feedback from the compressor and adjusting the predetermined threshold and one or more terms of the function based on the feedback.

15. The method of claim 14 wherein the one or more procedures to protect the compressor include shutting down the compressor, throttling a pressure regulator valve of an evaporator associated with the compressor, adjusting an expansion valve associated with the evaporator, reducing speed of the compressor, and partially or wholly unloading the compressor.

16. The method of claim 14 wherein the sensor senses the temperature at a discharge port of the compressor.

17. The method of claim 14 wherein the sensor senses the temperature at a suction port of the compressor.

18. The method of claim 14 further comprising subsequent to shutting down the compressor, restarting the compressor, with the controller, using a bump-start procedure after shutting down the compressor based on the rate of change of the temperature.

19. The method of claim 14 further comprising shutting down the compressor, with the controller, based on the rate of change of the temperature without knowledge of operating conditions of the compressor including suction superheat and suction and discharge pressures of the compressor.

20. The method of claim 14 further comprising shutting down the compressor, with the controller, based on the rate of change of the temperature by assuming a value of suction superheat before a flood-back event occurs.

21. The method of claim 14 further comprising shutting down and restarting the compressor, with the controller, using a bump-start procedure based on data received from a remote controller irrespective of whether the rate of change of the temperature indicates occurrence of a flood-back event requiring a shut down and restart of the compressor using the bump-start procedure.

22. The method of claim 18 wherein the compressor is a variable capacity compressor, the method further comprising operating the compressor, with the controller, at a lower than normal capacity during at least a portion of the bump-start procedure.

23. The method of claim 14 further comprising:

adjusting, with the controller, the predetermined threshold based on a difference between the sensed temperature and a minimum discharge line temperature representing zero suction superheat or an acceptable wet suction quality limit; and shutting down the compressor, with the controller, by comparing the value of the integrated function to the predetermined threshold adjusted based on the minimum discharge line temperature.

24. The method of claim 14 further comprising adjusting, with the controller, one or more terms of the function based on a location of the sensor relative to the compressor to account for a temperature shift or a response time difference caused based on the location of the sensor.

25. The method of claim 23 further comprising receiving, with the controller, the minimum discharge line temperature determined by a remote controller based on a plurality of operating parameters of the compressor including properties of refrigerant, efficiency of the compressor, and suction and discharge pressures of the compressor.

26. The method of claim 14 further comprising:

receiving, with the controller, the feedback from a knock sensor indicating a change in cylinder pressure in the compressor based on amount of liquid entering a cylinder of the compressor;

wherein the feedback includes a temperature measurement of lubricant sump or a difference between the temperature measurement of lubricant sump and a saturated suction temperature; or wherein the feedback includes a change in amperage of compressor motor or compressor power indicating liquid entering compression chamber of compressor.

* * * * *